US008047584B2

(12) United States Patent
Rock

(10) Patent No.: US 8,047,584 B2
(45) Date of Patent: Nov. 1, 2011

(54) STRIKER ASSEMBLY

(75) Inventor: Michael D. Rock, Clarkston, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 290 days.

(21) Appl. No.: 12/420,103

(22) Filed: Apr. 8, 2009

(65) Prior Publication Data

US 2010/0257786 A1 Oct. 14, 2010

(51) Int. Cl.
*E05B 15/02* (2006.01)
*E05B 15/00* (2006.01)

(52) U.S. Cl. ..... 292/340; 292/341.15; 292/341.17; 292/DIG. 42; 292/DIG. 61

(58) Field of Classification Search ..... 292/340, 292/341.13, 341.15, 341.16, 341.17, DIG. 42, 292/DIG. 61
See application file for complete search history.

(56) References Cited

U.S. PATENT DOCUMENTS

| | | | | |
|---|---|---|---|---|
| 5,020,838 | A | 6/1991 | Fukumoto | |
| 5,967,572 | A * | 10/1999 | Sajfert et al. | 292/336.3 |
| 6,364,380 | B2 * | 4/2002 | Franz | 292/219 |
| 7,344,169 | B2 | 3/2008 | Han | |
| 7,467,493 | B2 | 12/2008 | Udriste et al. | |
| 2005/0077734 | A1 * | 4/2005 | Lim | 292/216 |
| 2005/0156447 | A1 * | 7/2005 | Bishop et al. | 296/76 |
| 2009/0243311 | A1 * | 10/2009 | Johnson et al. | 292/219 |

FOREIGN PATENT DOCUMENTS

| | | | |
|---|---|---|---|
| EP | 322266 | A1 * | 6/1989 |
| EP | 894919 | A1 * | 2/1999 |

* cited by examiner

*Primary Examiner* — Carlos Lugo
(74) *Attorney, Agent, or Firm* — Quinn Law Group, PLLC

(57) ABSTRACT

A striker assembly includes a plate configured for attachment to a vehicle and a striker attached to the plate. The striker is configured for securing a latch assembly of the vehicle in a first position. The striker assembly also includes a first resilient member configured for contacting the latch assembly in the first position and a second resilient member configured for cooperating with the first resilient member to move the latch assembly to a second position.

17 Claims, 8 Drawing Sheets

STRIKER ASSEMBLY

TECHNICAL FIELD

The present invention generally relates to fastening devices for vehicles, and more specifically, to a striker assembly for a vehicle.

BACKGROUND OF THE INVENTION

Vehicle components that are pivotably coupled to other components, such as decklids and vehicle bodies, may be latched via interaction between a latch assembly and a striker assembly. In particular, when a decklid is in a closed position, a hook of the latch assembly may engage with a striker of the striker assembly to latch the decklid to the vehicle body.

Ideally, when a user releases the hook of the latch assembly, the decklid should separate from the vehicle body by a predetermined gap, i.e., the decklid should "pop-up" from the vehicle body. This predetermined gap allows the user to grasp an edge of the decklid and access a storage compartment of the vehicle. Such separation is especially important for vehicles exposed to snow and ice buildup, since such buildup may increase the weight of the decklid and/or freeze vehicle seals between the decklid and the vehicle body. Such separation is also important for vehicles having flush exterior styling, since such styling may not include a grasping point, e.g. an indentation, to allow the user to raise the decklid.

SUMMARY OF THE INVENTION

A striker assembly includes a plate configured for attachment to a vehicle. Further, the striker assembly includes a striker attached to the plate and configured for securing a latch assembly of the vehicle in a first position. The striker assembly also includes a first resilient member configured for contacting the latch assembly in the first position and a second resilient member configured for cooperating with the first resilient member to move the latch assembly to a second position.

In one embodiment, the striker assembly includes a plate defining two holes and configured for attachment to the vehicle via the two holes. The striker assembly also includes a striker attached to the plate between the two holes and configured for securing the latch assembly of the vehicle in the first position. Additionally, the striker assembly includes a clock spring configured for contacting the latch assembly in the first position and a retainer removably attached to the striker. The striker assembly also includes a coil spring supported by the retainer and configured for cooperating with the clock spring to move the latch assembly to the second position. The clock spring and the coil spring together exert a force sufficient to separate a first component of the vehicle from a second component of the vehicle by at least 8 mm.

In another embodiment, the striker assembly includes the plate configured for attachment to the vehicle, a striker attached to the plate and configured for securing the latch assembly of the vehicle in a first position, and the clock spring configured for contacting the latch assembly in the first position. Additionally, the striker assembly includes a retainer including a first arm, a second arm substantially perpendicular to the first arm, and a support surface protruding from the second arm. Further, the striker assembly includes the coil spring supported by the retainer and configured for cooperating with the clock spring to move the latch assembly to the second position. The clock spring and the coil spring together exert a force sufficient to separate the first component of the vehicle from the second component of the vehicle by at least 8 mm.

The striker assembly provides excellent separation between the first component and the second component of the vehicle upon release of a hook of the latch assembly, even for vehicles exposed to snow and ice buildup and/or having flush exterior styling. Further, the striker assembly does not require pairing with other devices, such as other striker assemblies, to exert the force sufficient to separate the first component and the second component by at least 8 mm. Additionally, the striker assembly is cost-effective manufacture and install in the vehicle.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
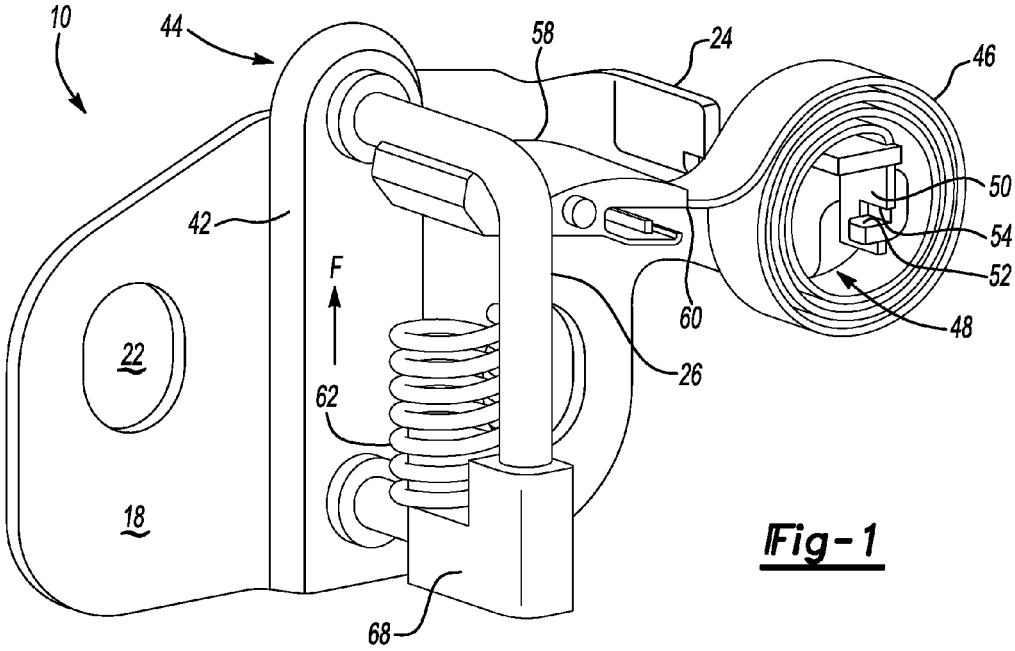
FIG. 1 is a schematic perspective view of a striker assembly.

Referring to the Figures, wherein like reference numerals refer to like components, a striker assembly is shown generally at 10 in FIG. 1. Referring to FIG. 2A, the striker assembly 10 may be useful for automotive applications, such as applications requiring pivotably coupled components on a vehicle 12, such as, but not limited to, a decklid 14 and a vehicle body 16, a hood (not shown) and the vehicle body 16, or a door (not shown) and the vehicle body 16. However, it is to be appreciated that the striker assembly 10 may also be useful for non-automotive applications, such as, but not limited to, aviation and recreational vehicle applications.

Referring to FIGS. 1 and 2A, the striker assembly 10 includes a plate 18 configured for attachment to the vehicle 12. The plate 18 may be attached to a first component 20 of the vehicle 12. As such, the plate 18 may have any shape suitable for attachment to the first component 20. For example, as shown generally and not to scale in FIG. 2A, the plate 18 may be attached to the vehicle body 16 and have a generally rectangular shape. The plate 18 may be formed from any suitable material, such as, but not limited to, steel or plastic.

Additionally, the plate 18 may be mounted to the first component 20 of the vehicle 12, e.g. the vehicle body 16, by any suitable method known in the art. For example, the plate 18 may be welded, screwed, bolted, or adhered to the vehicle body 16. Referring to FIG. 1, the plate 18 may define at least one hole 22 configured for mounting the plate 18 to the vehicle 12. That is, the hole 22 may provide a cavity for receiving, for example, a screw or bolt.

Referring to FIG. 1, the plate 18 may have an armature 24 that extends generally perpendicularly from the plate 18. That is, the armature 24 may protrude from the plate 18. The armature 24 may be unitary with the plate 18 or may be separately affixed to the plate 18. The armature 24 may support another component of the striker assembly 10, as set forth in more detail below.

Figure 2B:
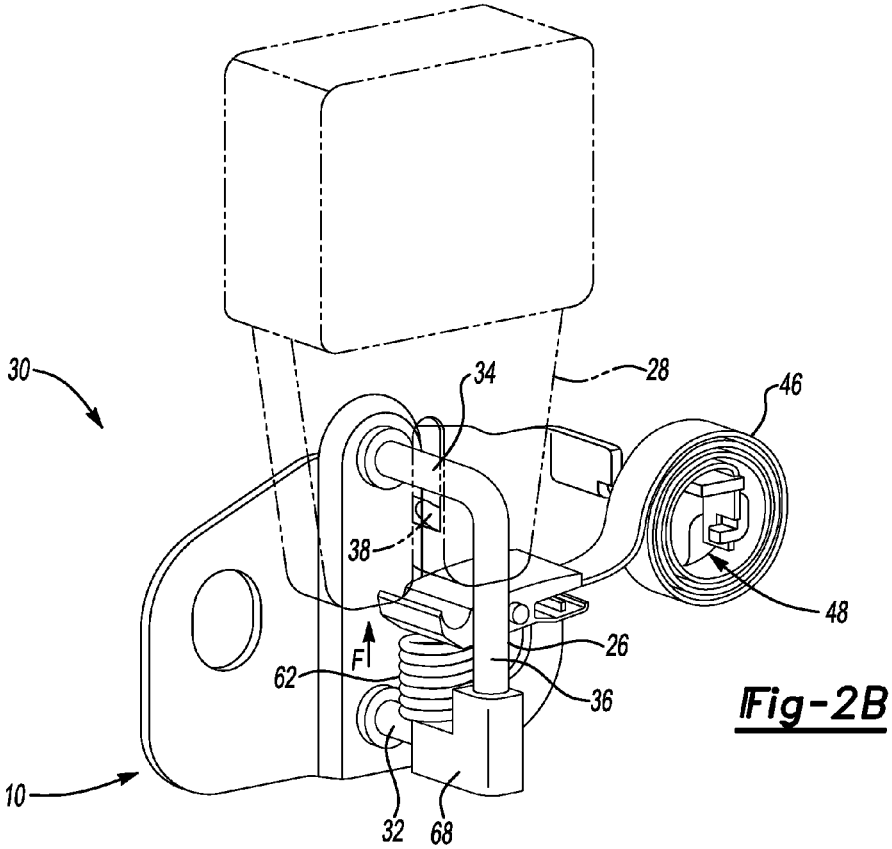
FIG. 2B is an enlarged schematic perspective view of a portion of FIG. 2A including the phantom latch assembly engaged with the striker assembly of FIG. 1 in the first position.
Figure 2A:
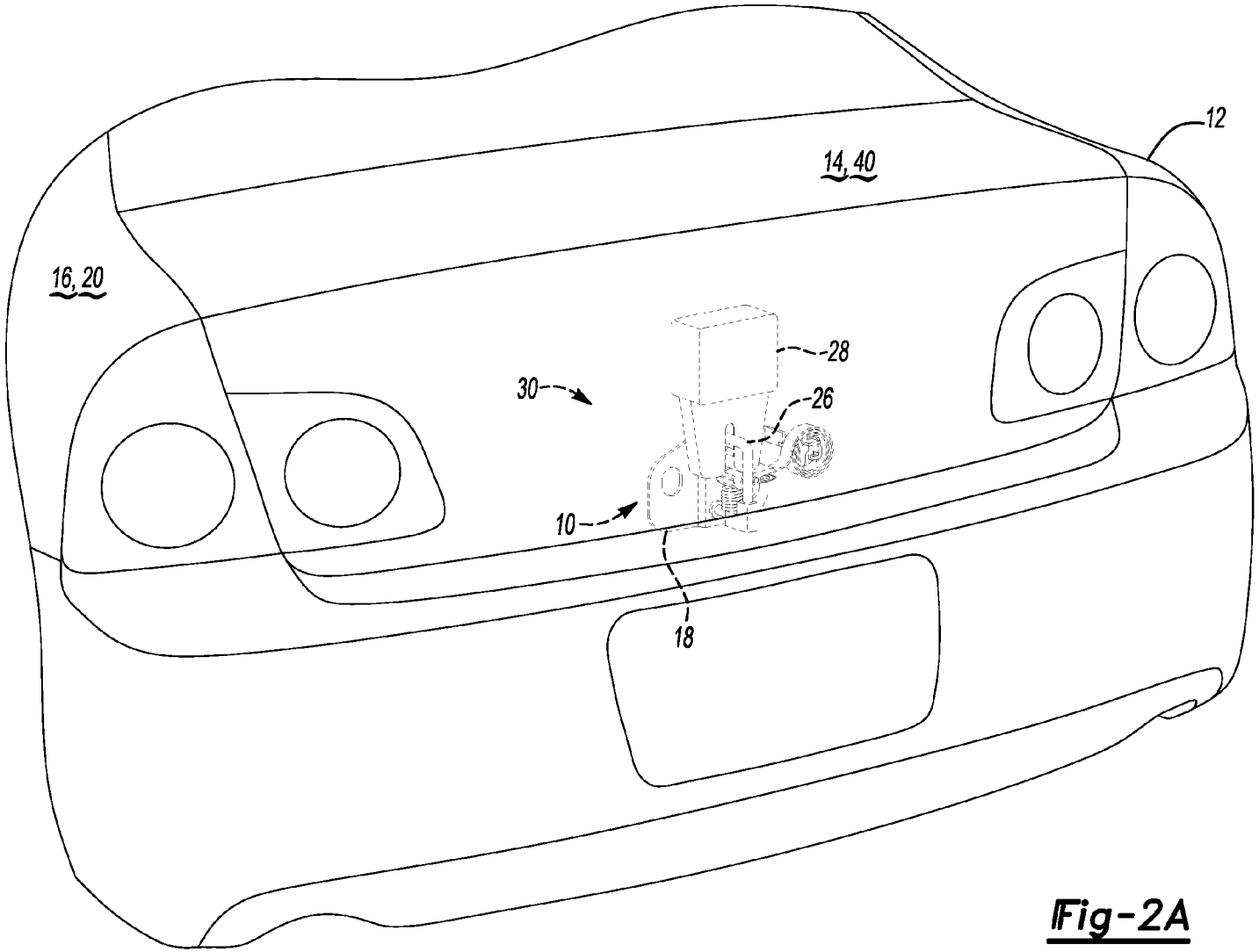
FIG. 2A is a schematic partial perspective view of a rear of a vehicle, including a schematic phantom latch assembly secured by the phantom striker assembly of FIG. 1 in a first position.

Referring to FIGS. 1, 2A, and 2B, the striker assembly 10 includes a striker 26 configured for securing a latch assembly 28 of the vehicle 12 in a first position 30. The striker 26 may be substantially U-shaped. As used herein, the terminology "substantially" and "generally" is used to represent the inherent degree of uncertainty that may be attributed to any quantitative comparison, value, measurement, or other representation. As such, it refers to an arrangement of elements or features that, while in theory would be expected to exhibit exact correspondence or behavior, may in practice embody something slightly less than exact. The term also represents the degree by which a quantitative representation may vary from a stated reference without resulting in a change in the basic function of the subject matter at issue. Therefore, it is contemplated that the striker 26 may be slightly less than or more than U-shaped. For example, the striker 26 may be V-shaped, arc-shaped, and/or D-shaped. That is, the striker 26 may include one or more straight portions. For example, as shown in FIG. 2B, the striker 26 may include a first portion 32 spaced apart from a second portion 34 and connected by a third portion 36. The striker 26 may be formed from any material suitable for automotive applications. For example, the striker 26 may be formed from steel wire.

As set forth above, the striker 26 is configured for securing the latch assembly 28 of the vehicle 12 in the first position 30, as shown in FIGS. 2A and 2B. As known in the art, the latch assembly 28 generally includes a hook 38 configured for engagement with the striker 26 of the striker assembly 10, as shown in FIG. 2B, and may be attached to a second component 40 of the vehicle 12, as shown in FIG. 2A. For example, the latch assembly 28 may be attached to the decklid 14 of the vehicle 12. Therefore, in operation, the striker 26 may mate with the latch assembly 28 to secure the latch assembly 28 in the first position 30. In particular, the first position 30 may be a secure, e.g., latched, position. For example, when the striker 26 secures the latch assembly 28 in the first position 30, the decklid 14 may be closed to the vehicle body 16, as shown generally in FIG. 2A.

Referring to FIG. 1, the striker 26 is attached to the plate 18. The striker 26 may be attached to the plate 18 by any suitable method known in the art. For example, the striker 26 may be welded, screwed, bolted, or adhered to the plate 18. Similarly, the striker 26 may be attached to the plate 18 in any suitable location on the plate 18. For example, the striker 26 may be generally centered on the plate 18.

More specifically, the striker 26 may protrude from the plate 18. For example, referring to FIG. 1, the plate 18 may define a protrusion 42 configured for attachment of the striker 26. That is, the protrusion 42 may be formed by bending a middle portion of the plate 18. In particular, the protrusion 42 may protrude outward from the plate 18 in the same direction as the protruding striker 26. The protrusion 42 may generally form a corresponding depression, not specifically shown, but indicated generally at 44 in FIG. 1, on a rear side of the plate 18, i.e., a side of the plate 18 configured for mounting to the first component 20 shown in FIG. 2A. The depression 44 may allow the plate 18 to be mounted to the first component 20, e.g. the vehicle body 16, by preventing the striker 26 from protruding from the rear side of the plate 18. That is, the protrusion 42 and corresponding depression 44 may allow clearance for any attachment, e.g., a bolt and nut, between the plate 18 and the vehicle body 16.

Referring to FIGS. 1 and 2B, the striker assembly 10 includes a first resilient member 46. In use, the first resilient member 46 may exert a portion of a force F necessary to move the latch assembly 28 from the first position 30, as set forth in more detail below. As such, the first resilient member 46 may be any resilient member known in the art. For example, the first resilient member 46 may be a spring or an elastic membrane. More specifically, the first resilient member 46 may be a clock spring. As used herein, the terminology "clock spring" refers to a flat spring generally coiled into a flat shape that defines a cavity 48, wherein each coil nests inside an adjacent larger coil to define the cavity 48, as shown in FIG. 1. The first resilient member 46 may include a progressive spring rate. That is, the first resilient member 46 may have differing spring rates in one or more coil, and/or may include coils with differing diameters and/or differing spacing between each coil. The first resilient member 46 may be formed from any material suitable for providing resilience. For example, the first resilient member 46 may be formed from steel. Alternatively, the first resilient member 46 may be formed from plastic.

Referring to FIG. 1, the first resilient member 46 may be supported by the armature 24. That is, the first resilient member 46 may rest on the armature 24. For example, the armature 24 may extend through the cavity 48 defined by the first resilient member 46. Further, a first end 50 of the first resilient member 46 may be retained by the armature 24. That is, the first end 50 and the armature 24 may include corresponding notched surfaces 52, 54 configured for interlocking so that the armature 24 may retain the first resilient member 46.

Referring to FIGS. 2A and 2B, the first resilient member 46 is configured for contacting the latch assembly 28 in the first position 30. That is, the first resilient member 46 may rest upon the latch assembly 28 when the latch assembly 28 is secured by the striker 26 in the first position 30, e.g. the latched position. In use, when a user moves the latch assembly 28 from the first position 30, shown generally in FIGS. 2A and 2B, to a second position 56, e.g. an unlatched position, shown generally in FIGS. 3A (not to scale) and 3B, the first resilient member 46 pushes against the latch assembly 28 to exert a portion of the force F necessary to move the latch assembly 28 from the first position 30.

Referring to FIG. 1, the striker assembly 10 may further include a bumper 58 fixedly attached to a second end 60 of the first resilient member 46 and configured for protecting the latch assembly 28 during contact with the first resilient member 46. As such, the bumper 58 may be formed from any suitable protective material. For example, the bumper 58 may be formed from plastic. Further, the bumper 58 may be rectangular-shaped and have a surface area greater than a surface area of the second end 60 of the first resilient member 46. That is, the bumper 58 may generally provide a comparatively larger contact point with the latch assembly 28 than the second end 60 of the first resilient member 46 alone. The bumper 58 may also generally provide a contact surface with another component of the striker assembly 10, as set forth in more detail below. The bumper 58 may be fixedly attached, e.g. chemically bonded via an adhesive and/or physically bonded via an interference fit, to the second end 60 of the first resilient member 46 so that the bumper 58 remains attached to the first resilient member 46 during use.

Figure 3A:
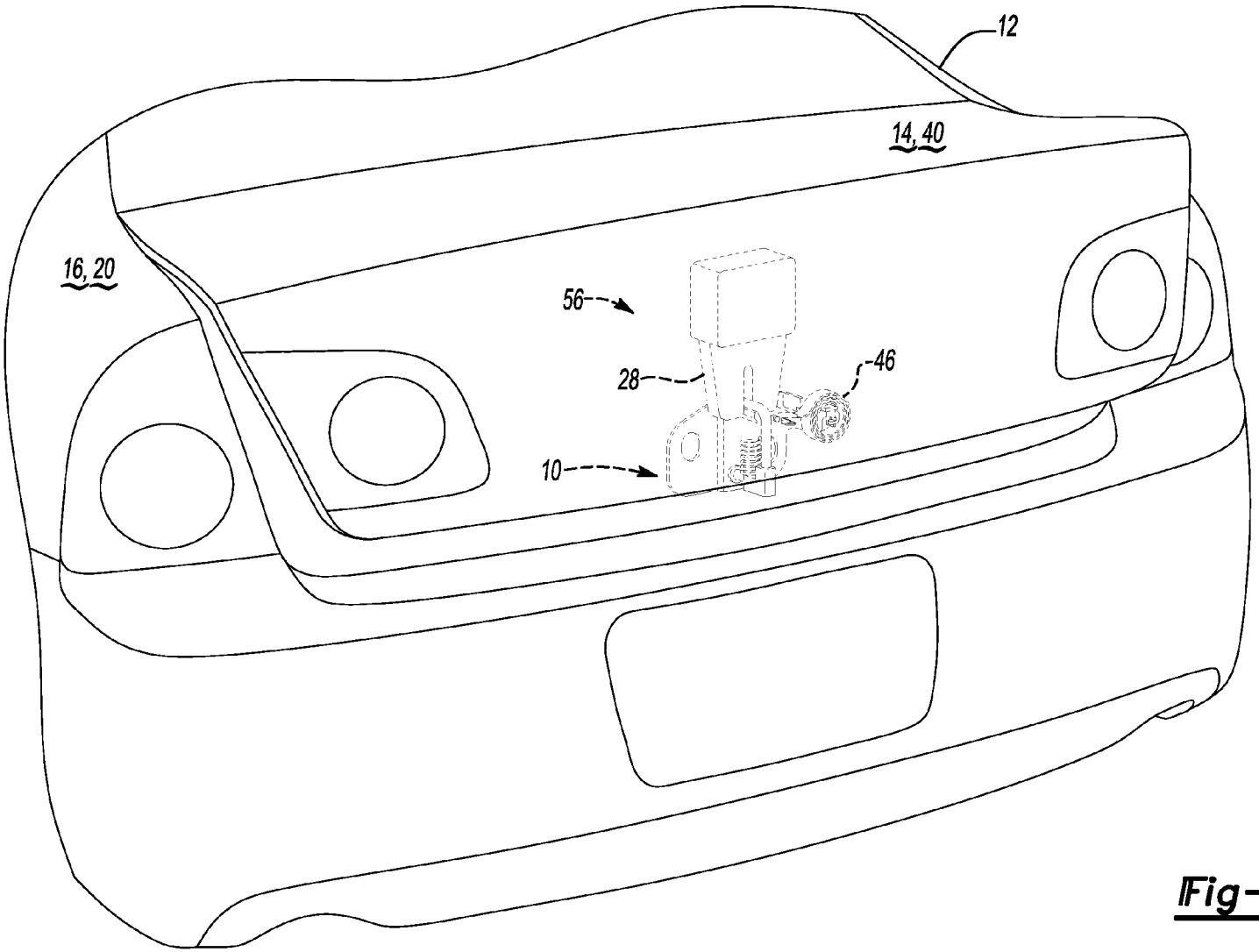
FIG. 3A is a schematic partial perspective view of the rear of the vehicle of FIG. 2A, including the schematic phantom latch assembly and the phantom striker assembly of FIG. 2A disposed in a second position.
Figure 3B:
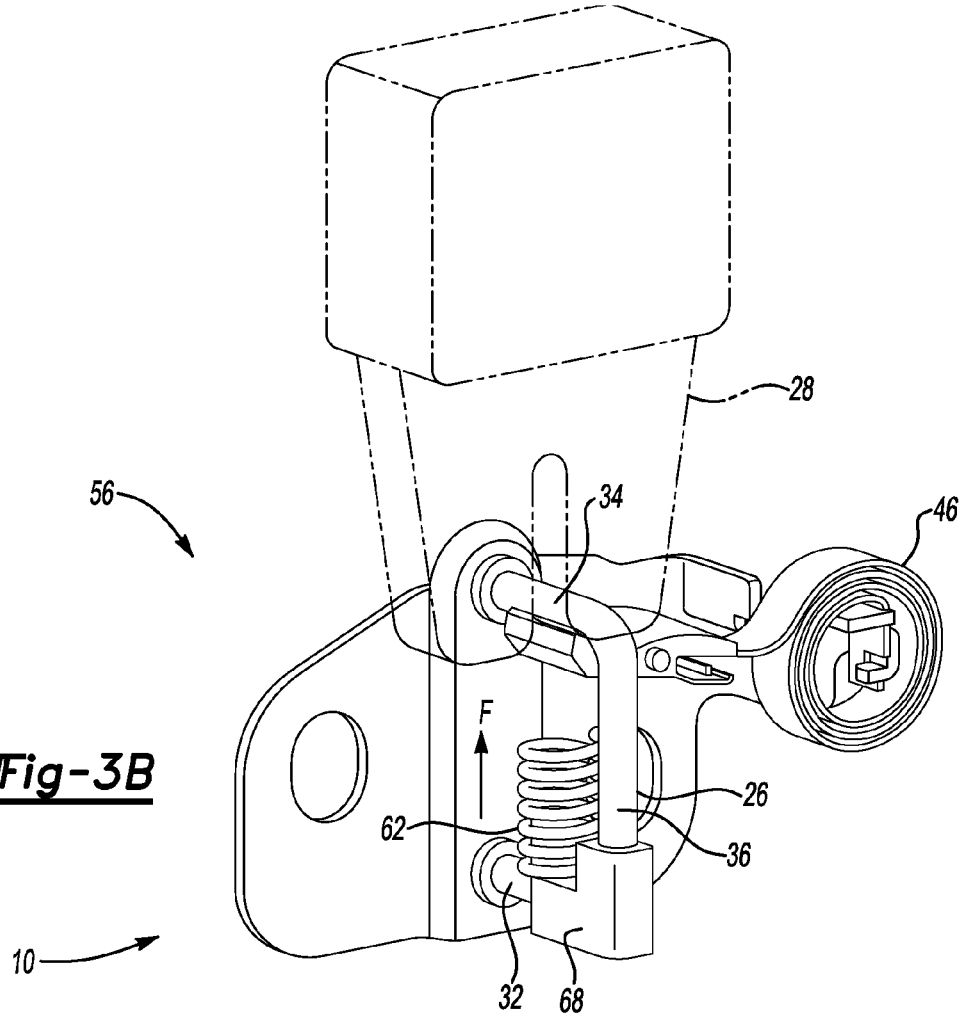
FIG. 3B is an enlarged schematic perspective view of a portion of FIG. 3A including the phantom latch assembly disengaged from the striker assembly of FIG. 1 in the second position.

Referring to FIGS. 1, 2B, and 3B, the striker assembly 10 includes a second resilient member 62 configured for cooperating with the first resilient member 46 to move the latch assembly 28 to the second position 56 shown in FIG. 3B. In use, the second resilient member 62 may exert another portion of the force F necessary to move the latch assembly 28 from the first position 30 shown in FIG. 2B. As such, the second resilient member 62 may be any resilient member known in the art. For example, the second resilient member 62 may be a spring or an elastic membrane. More specifically, the second resilient member 62 may be a coil spring. As used herein, the terminology "coil spring" refers to a helical spring that generally returns to an original length when unloaded. In particular, the coil spring may be a compression coil spring configured for resistance to compression. The second resilient member 62 may have a higher spring rate as compared to the first resilient member 46. That is, an amount of weight necessary to coil or compress the second resilient member 62 a specified distance may be greater than an amount of weight necessary to compress the first resilient member 46. Stated differently, the second resilient member 62 may be stiffer than the first resilient member 46. Likewise, the first resilient member 46 may have a higher spring rate as compared to the second resilient member 62. Further, the second resilient member 62 may include a progressive spring rate. That is, the second resilient member 62 may have differing spring rates in one or more coil, and/or may include coils with differing diameters and/or differing spacing between each coil. The second resilient member 62 may be formed from any material suitable for providing resilience. For example, the second resilient member 62 may be formed from steel. Alternatively, the second resilient member 62 may be formed from plastic.

In use, the first resilient member 46 and the second resilient member 62 may cooperate to move the latch assembly 28 to the second position 56, e.g., the unlatched position shown in FIG. 3B. For example, when the latch assembly 28 is secured to the striker assembly 10 in the first position 30, e.g. the latched position, of FIG. 2B, the first resilient member 46 may contact and compress the second resilient member 62, or the bumper 58. Further, as set forth above, while contacting and compressing the second resilient member 62, the first resilient member 46 may also contact the latch assembly 28 via the bumper 58. Therefore, when a user moves the latch assembly 28 to the second position 56, e.g. an unlatched position, shown in FIG. 3B, the second resilient member 62 pushes against the first resilient member 46 to exert the other portion of the force F necessary to move the latch assembly 28 from the first position 30 shown in FIG. 2B. And, as set forth above, the first resilient member 46 pushes against the latch assembly 28 to exert a portion of the force F necessary to move the latch assembly 28 from the first position 30. Therefore, the second resilient member 62 augments the portion of the force F exerted by the first resilient member 46 to move the latch assembly 28 from the first position 30 to the second position 56.

Stated differently, the striker assembly 10 may be described as a "two-stage" striker assembly 10. That is, the striker assembly 10 may include a progressive spring rate. More specifically, the comparatively higher spring rate of the second resilient member 62 sets the latch assembly 28 in motion and overcomes any static friction caused by, for example, increased mass from ice or snow buildup or frozen seals, between the first component 20 and the second component 40 of the vehicle 12. Then, the comparatively lower spring rate of the first resilient member 46 continues to move the latch assembly 28 so as to "pop-up" the second component 40 of the vehicle 12, as shown in FIG. 3A. In reverse, e.g. when a user closes the second component 40 towards the first component 20 to dispose the latch assembly 28 in the first position 30, the user overcomes the lower spring rate of the first resilient member 46 through a majority of the closing, i.e., the pivoting of the second component 40 towards the first component 20, as shown in FIG. 2A. The user then overcomes the higher spring rate of the second resilient member 62 during only a minority of the closing, at which point the hook 38 is already engaged with the striker 26 so that the user is likely unaware of the higher spring rate of the second resilient member 62. Therefore, the comparatively higher spring rate of the second resilient member 62 combines with the lower spring rate of the first resilient member 46 to equal the progressive spring rate.

More specifically, the first resilient member 46 and the second resilient member 62 together may exert the force F sufficient to separate a first component 20 of the vehicle 12 from a second component 40 of the vehicle 12 by at least 8 mm, more preferably at least 12 mm. For example, the first component 20 may be the vehicle body 16 pivotably coupled to the second component 40, e.g. the decklid 14, as shown in FIG. 2A. That is, the striker assembly 10 may be a decklid striker assembly 10 configured for securing the decklid 14 and the vehicle body 16. In this example, the first resilient member 46 and the second resilient member 62 together may exert the force F sufficient to separate the decklid 14 from the vehicle body 16 by at least 8 mm, more preferably at least 12 mm, as shown generally and not to scale in FIG. 3A. Therefore, the striker assembly 10 provides excellent separation between the first component 20 and the second component 40 of the vehicle 12 upon release of the hook 38 of the latch assembly 28, even for vehicles exposed to snow and ice buildup and/or having flush exterior styling.

Figure 4:
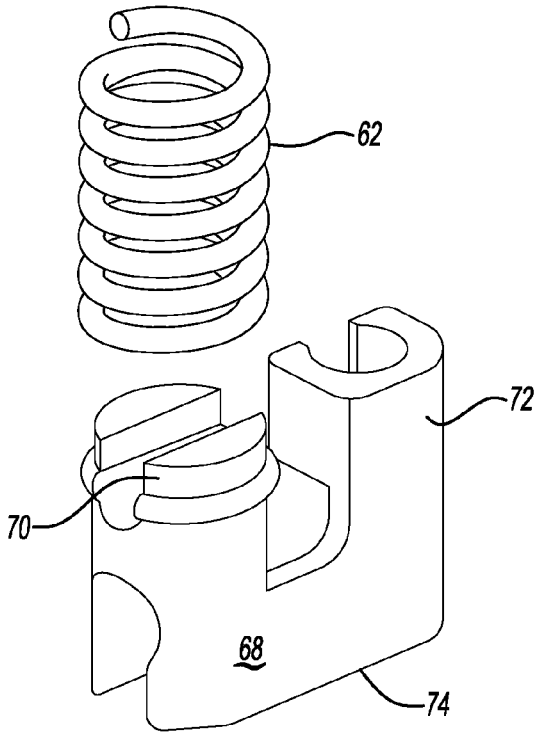
FIG. 4 is an exploded perspective view of a second resilient member and a retainer of the striker assembly of FIGS. 1-3B.

Referring to FIGS. 1 and 4, the striker assembly 10 may further include a retainer 68 configured for supporting the second resilient member 62. That is, the second resilient member 62 may rest on the retainer 68. Further, the retainer 68 may properly align the second resilient member 62 for contact and cooperation with the first resilient member 46.

The retainer 68 may be formed from any suitable material known in the art. For example, the retainer 68 may be formed from plastic. Further, the retainer 68 may have any suitable shape known in the art. For example, the retainer 68 may include a support surface 70, as shown in FIG. 4, for supporting the second resilient member 62.

In one example, the retainer 68 may be removably attached to the striker 26. That is, the retainer 68 may be removable from the striker 26 and may be attached to the striker 26 via a snap-fit or an interference fit. In this example, the retainer 68 may also be generally U-shaped. Thus, referring to FIGS. 4 and 2B, a first arm 72 of the retainer 68 may snap onto the third portion 36 of the striker 26, and a second arm 74 of the retainer 68 may snap onto the first portion 32 of the striker 26. When disposed in place on the striker 26, i.e., when removably attached to the striker 26, the support surface 70 of the retainer 68 may protrude from the second arm 74 of the retainer 68 toward the second portion 34 of the striker 26 and be configured for supporting the second resilient member 62.

Figure 5:
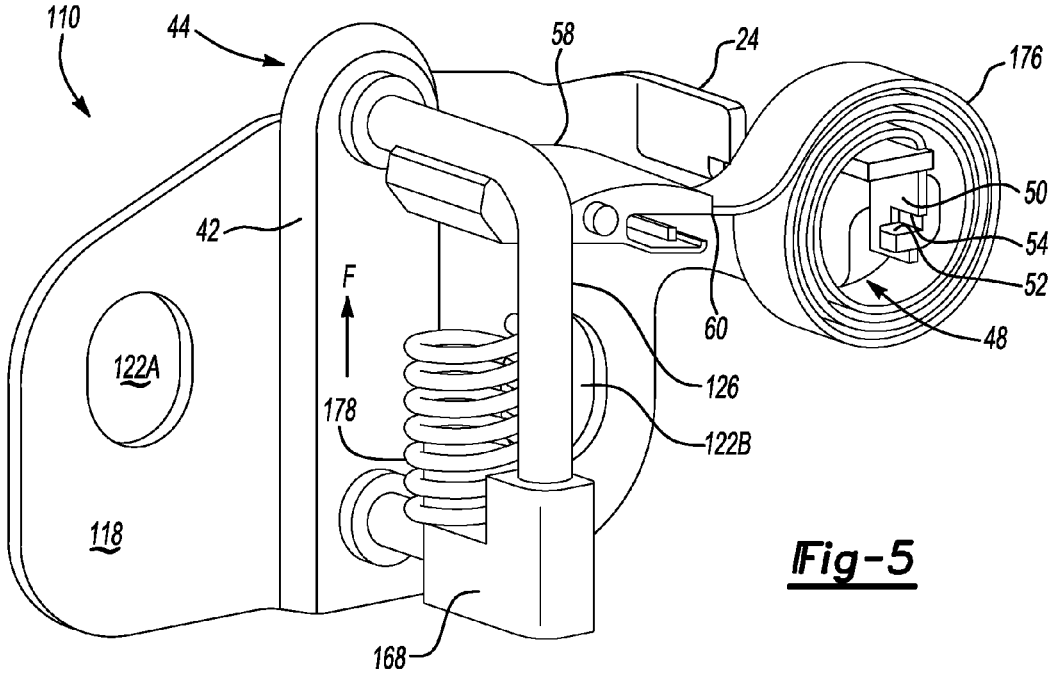
FIG. 5 is schematic perspective view of another embodiment of a striker assembly.
Figure 6B:
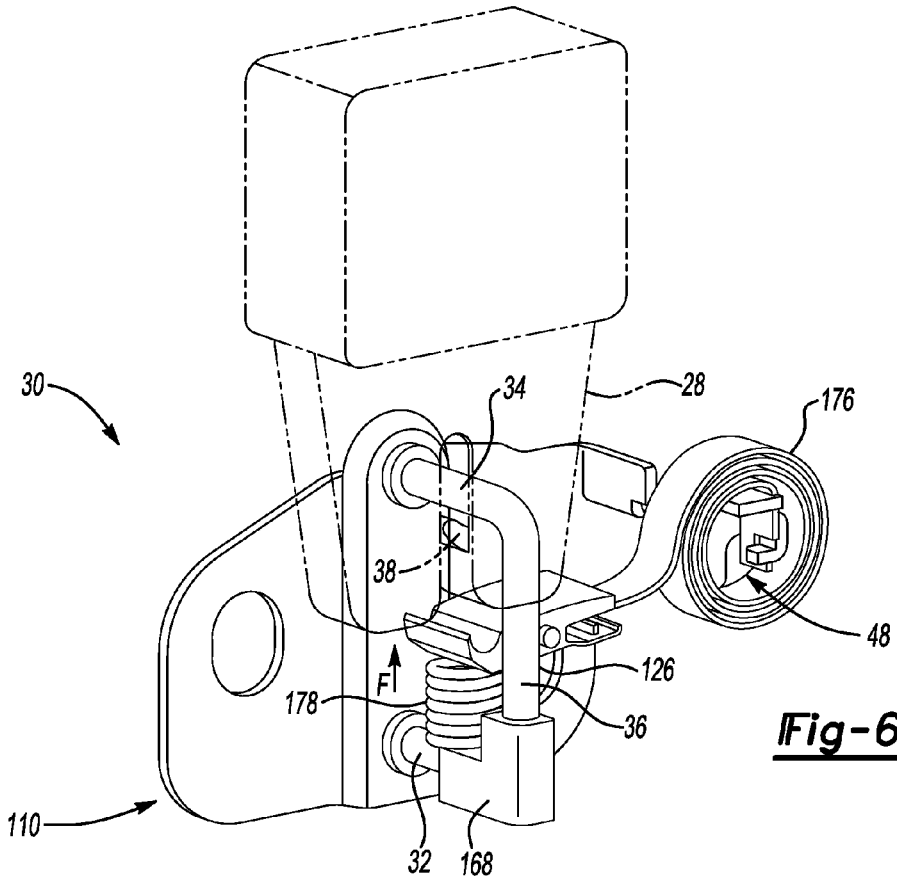
FIG. 6B is an enlarged schematic perspective view of a portion of FIG. 6A including the phantom latch assembly engaged with the striker assembly of FIG. 5 in the first position.
Figure 6A:
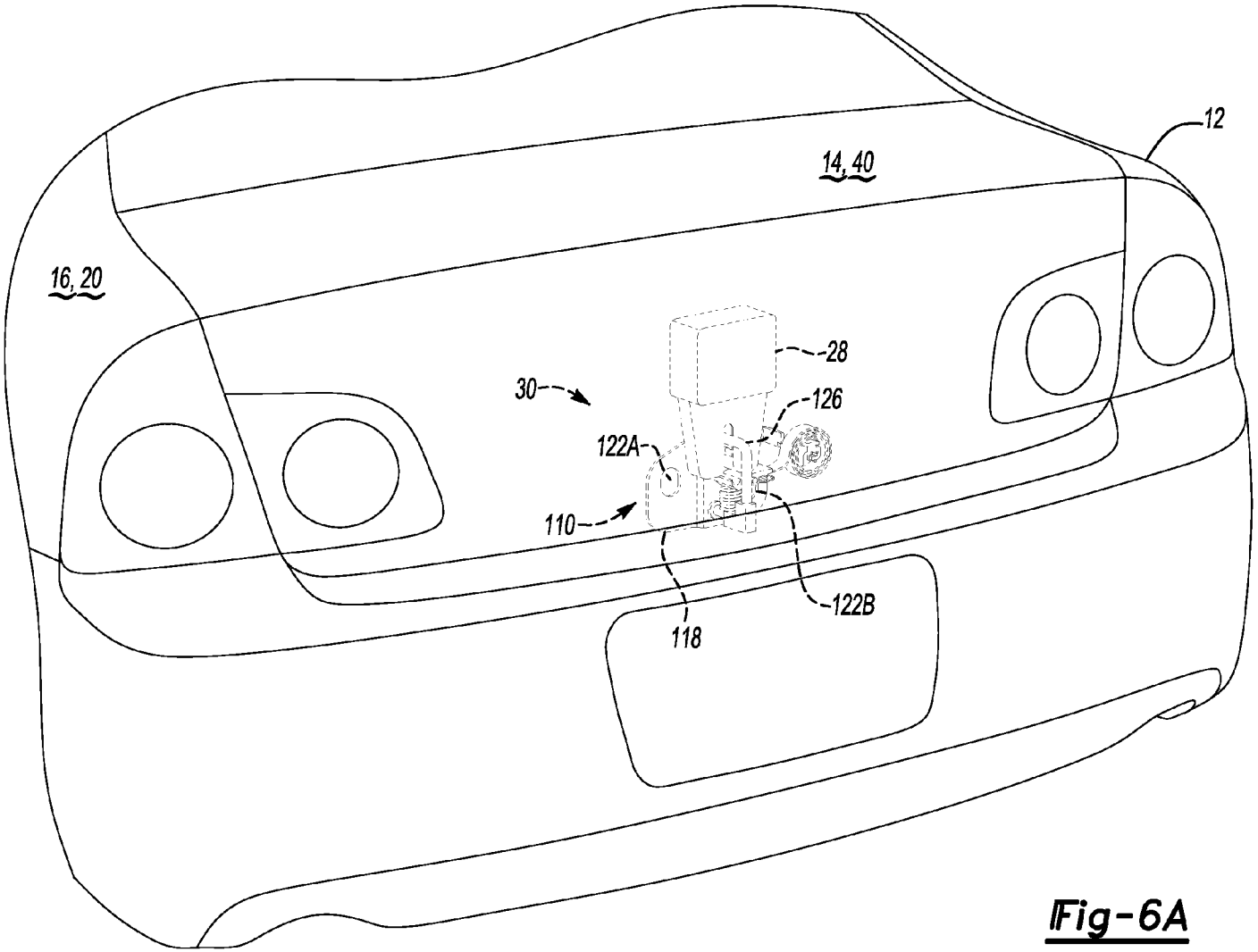
FIG. 6A is a schematic partial perspective view of a rear of a vehicle, including a schematic phantom latch assembly secured by the phantom striker assembly of FIG. 5 in a first position.

Referring to FIGS. 5 and 6A, in another embodiment, a striker assembly 110 includes a plate 118 defining two holes 122A, 122B configured for attachment to the vehicle 12 via the two holes 122A, 122B. The striker assembly 110 also includes a striker 126 attached to the plate 118 between the two holes 122A, 122B. For example, one hole 122A may be disposed to the right of the striker 126 and the other hole 122B may be disposed to the left of the striker 126, as shown in FIG. 5. Although not shown in FIG. 5, it is also to be appreciated that one hole 122A may be disposed above the striker 126 and the other hole may be disposed below the striker 126. Further, the two holes 122A, 122B may be offset from one another on a vertical, horizontal, and/or diagonal axis. The striker 126 is configured for securing the latch assembly 28 of the vehicle 12 in the first position 30 shown in FIG. 6A.

Referring to FIG. 6B, the striker assembly 110 also includes a clock spring 176 configured for contacting the latch assembly 28 in the first position 30 and a retainer 168 removably attached to the striker 126. The striker assembly 110 further includes a coil spring 178 supported by the retainer 168 and configured for cooperating with the clock spring 176 to move the latch assembly 28 to the second position 56 of FIG. 3B. The clock spring 176 and the coil spring 178 together exert the force F sufficient to separate the first component 20 of the vehicle 12, shown in FIG. 6A, from the second component 40 of the vehicle 12, also shown in FIG. 6A, by at least 8 mm. For example, referring again to FIG. 6A, the first component 20 of the vehicle 12 may be the vehicle body 16, and the second component 40 may be the decklid 14 of the vehicle 12.

Figure 7:
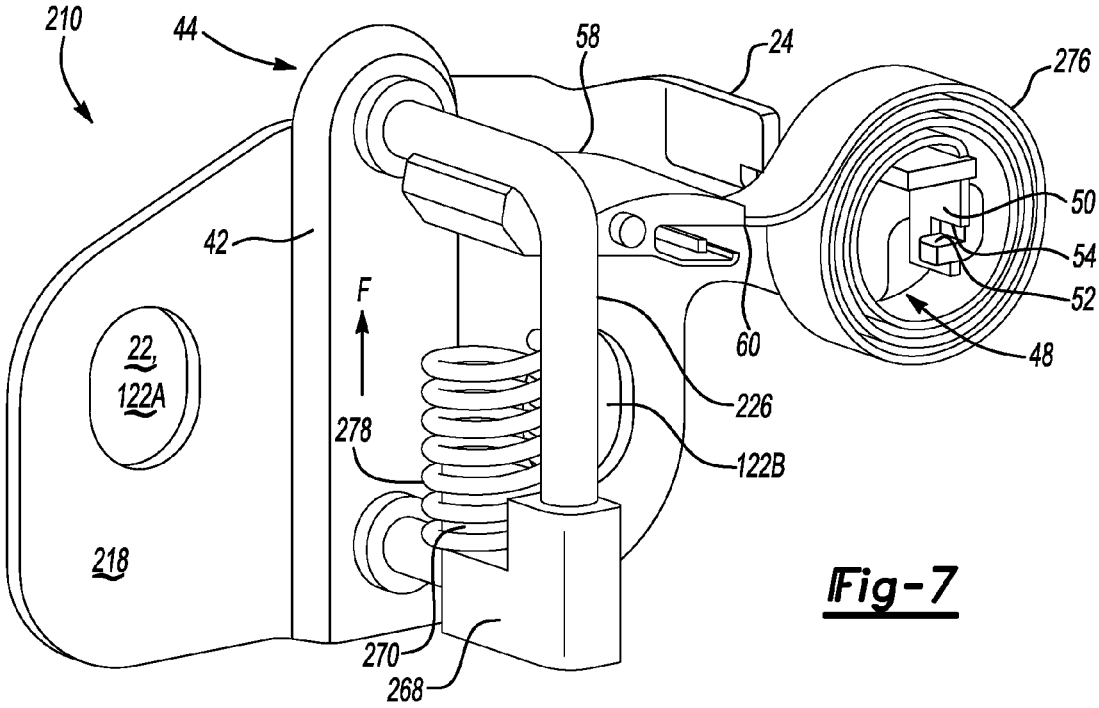
FIG. 7 is a schematic perspective view of another embodiment of a striker assembly.
Figure 8:
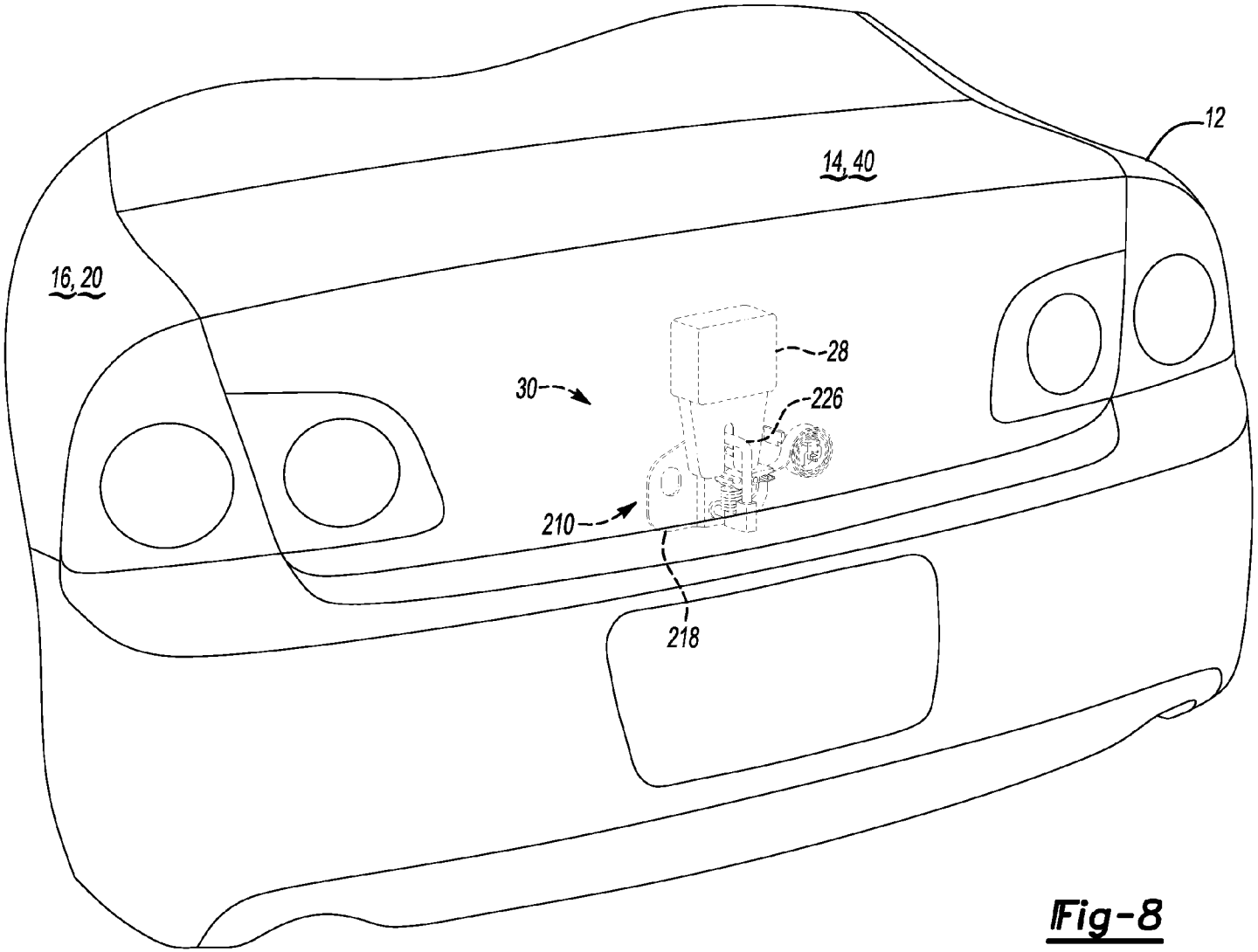
FIG. 8 is a schematic partial perspective view of a rear of a vehicle, including a schematic phantom latch assembly secured by the phantom striker assembly of FIG. 7 in a first position.

Referring to FIGS. 7 and 8, in another embodiment, a striker assembly 210 includes a plate 218 configured for attachment to the vehicle 12. The striker assembly 210 also includes a striker 226 attached to the plate 218 and configured for securing a latch assembly 28 of the vehicle 12 in the first position 30, shown in FIG. 8. The striker assembly 210 also includes a clock spring 276 configured for contacting the latch assembly 28 in the first position 30 of FIG. 8.

Figure 9:
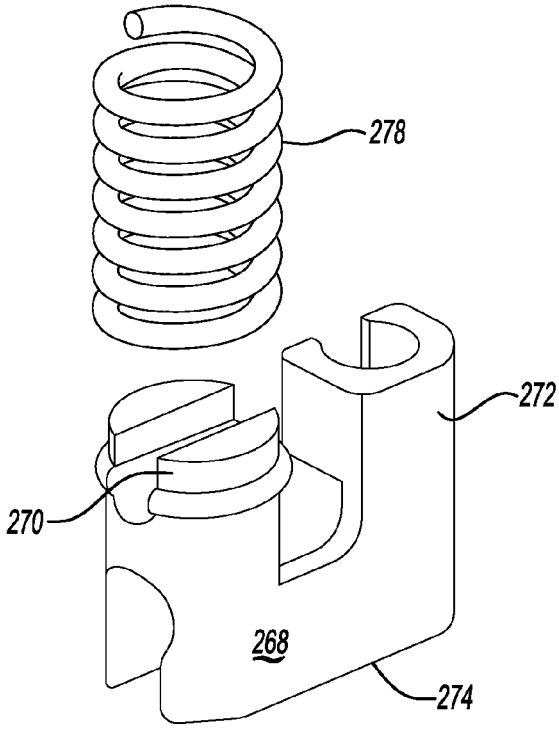
FIG. 9 is an exploded perspective view of a coil spring and a retainer of the striker assembly of FIG. 7.

Referring to FIG. 9, the striker assembly 210 also includes a retainer 268 including a first arm 272, a second arm 274 substantially perpendicular to the first arm 272, and a support surface 270 protruding from the second arm 274. Referring to FIGS. 7 and 9, the striker assembly 210 also includes a coil spring 278 supported by the retainer 268 and configured for cooperating with the clock spring 276 to move the latch assembly to the second position of FIG. 3B. That is, the coil spring 278 may rest on the support surface 270 of the retainer 268, as shown in FIG. 7. Further, the retainer 268 may properly align the coil spring 278 for contact and cooperation with the clock spring 276.

The retainer 268 may be formed from any suitable material known in the art. For example, the retainer 268 may be formed from plastic. Further, the retainer 268 may have any suitable shape known in the art.

The retainer 268 may be removably attached to the striker 226. That is, the retainer 268 may be removable from the striker 226 and may be attached to the striker 226 via a snap-fit or an interference fit. In this example, the retainer 268 may also be generally U-shaped. Thus, referring to FIG. 9, the first arm 272 of the retainer 268 and the second arm 274 of the retainer 268 may snap onto the striker 226, as shown in FIG. 7. When disposed in place on the striker 226, i.e., when removably attached to the striker 226, the support surface 270 of the retainer 268 may protrude from the second arm 274 of the retainer 268 and be configured for supporting the second resilient member 262.

In this embodiment, the clock spring 276 and the coil spring 278 together exert a force F sufficient to separate a first component 20 of the vehicle 12 from a second component 40 of the vehicle 12 by at least 8 mm. For example, the first component 20 of the vehicle 12 may be the vehicle body 16, and the second component 40 of the vehicle 12 may be the decklid 14.

Therefore, the striker assemblies 10, 110, 210 do not require pairing with other devices, such as other striker assemblies, to exert the force F sufficient to separate the first component 20 and the second component 40 by at least 8 mm. Additionally, the striker assemblies 10, 110, 210 are cost-effective to manufacture and install in the vehicle 12.

While the best modes for carrying out the invention have been described in detail, those familiar with the art to which this invention relates will recognize various alternative designs and embodiments for practicing the invention within the scope of the appended claims.

The invention claimed is:

1. A striker assembly comprising:

a plate configured for attachment to a vehicle;

a striker attached to said plate and configured for securing a latch assembly of the vehicle in a first position wherein said striker and the latch assembly are mated and latched;

a first resilient member configured for contacting the latch assembly in the first position;

a second resilient member configured for cooperating with said first resilient member to move the latch assembly to a second position wherein said striker and the latch assembly are unlatched; and a retainer configured for supporting said second resilient member, wherein said retainer is removably attached to said striker.

2. The striker assembly of claim 1, wherein said first resilient member and said second resilient member together exert a force sufficient to separate a first component of the vehicle from a second component of the vehicle by at least 8 mM.

3. The striker assembly of claim 1, wherein said first resilient member is a clock spring.

4. The striker assembly of claim 1, wherein said second resilient member is a coil spring.

5. The striker assembly of claim 1, wherein said plate has an armature that extends generally perpendicularly from said plate.

6. The striker assembly of claim 5, wherein said first resilient member is supported by said armature.

7. The striker assembly of claim 6, wherein said armature extends through a cavity defined by said first resilient member.

8. The striker assembly of claim 5, wherein a first end of said first resilient member is retained by said armature.

9. The striker assembly of claim 1, wherein said plate defines a protrusion configured for attachment of said striker.

10. The striker assembly of claim 1, wherein said plate defines at least one hole configured for mounting said plate to the vehicle.

11. The striker assembly of claim 1, further comprising a bumper fixedly attached to a second end of said first resilient member and configured for protecting the latch assembly during contact with said first resilient member.

12. The striker assembly of claim 1, wherein said striker is substantially U-shaped.

13. The striker assembly of claim 1, wherein said striker assembly is a decklid striker assembly.

14. A striker assembly comprising:

a plate defining two holes and configured for attachment to a vehicle via said two holes;

a striker attached to said plate between said two holes and configured for securing a latch assembly of the vehicle in a first position wherein said striker and the latch assembly are mated and latched;

a clock spring configured for contacting the latch assembly in the first position;

a retainer removably attached to said striker; and a coil spring supported by said retainer and configured for cooperating with said clock spring to move the latch assembly to a second position wherein said striker and the latch assembly are unlatched;

wherein said clock spring and said coil spring together exert a force sufficient to separate a first component of the vehicle from a second component of the vehicle by at least 8 mM.

15. The striker assembly of claim 14, wherein said first component is a vehicle body.

16. The striker assembly of claim 14, wherein said second component is a decklid of the vehicle.

17. A striker assembly comprising:

a plate configured for attachment to a vehicle;

a striker attached to said plate and configured for securing a latch assembly of the vehicle in a first position wherein said striker and the latch assembly are mated and latched;

a clock spring configured for contacting the latch assembly in the first position;

a retainer removably attached to said striker and including;

a first arm;

a second arm substantially perpendicular to said first arm; and a support surface protruding from said second arm; and a coil spring supported by said retainer and configured for cooperating with said clock spring to move the latch assembly to a second position wherein said striker and the latch assembly are unlatched;

wherein said clock spring and said coil spring together exert a force sufficient to separate a first component of the vehicle from a second component of the vehicle by at least 8 mM.

* * * * *